US010403176B1

(12) United States Patent
Ycedo

(10) Patent No.: US 10,403,176 B1
(45) Date of Patent: Sep. 3, 2019

(54) BLUEFLAGPROTECTION AUTOMATIC LED DISPLAY DAMPENED FOOT RELEASED SIGN POLE SYSTEMS

(71) Applicant: Arthur Robert Ycedo, Rancho Belago, CA (US)

(72) Inventor: Arthur Robert Ycedo, Rancho Belago, CA (US)

( * ) Notice: Subject to any disclaimer, the term of this patent is extended or adjusted under 35 U.S.C. 154(b) by 0 days.

(21) Appl. No.: 15/613,208

(22) Filed: Feb. 23, 2018

(51) Int. Cl.

| | |
|---|---|
| ***G09F 7/18*** | (2006.01) |
| ***G09F 7/22*** | (2006.01) |
| ***F21V 23/04*** | (2006.01) |
| ***F21S 9/03*** | (2006.01) |
| ***F21V 15/01*** | (2006.01) |
| ***F21S 8/08*** | (2006.01) |
| ***G08G 1/09*** | (2006.01) |
| ***G09F 13/00*** | (2006.01) |
| ***B61L 5/18*** | (2006.01) |
| ***B61L 5/12*** | (2006.01) |
| *F21Y 115/10* | (2016.01) |
| *F21Y 103/10* | (2016.01) |
| *F21Y 113/13* | (2016.01) |

(52) U.S. Cl.
CPC ..... *G09F 7/22* (2013.01); *B61L 5/125* (2013.01); *B61L 5/189* (2013.01); *F21S 8/08* (2013.01); *F21S 9/032* (2013.01); *F21V 15/01* (2013.01); *F21V 23/0464* (2013.01); *G08G 1/09* (2013.01); *G09F 7/18* (2013.01); *G09F 13/005* (2013.01); *F21Y 2103/10* (2016.08); *F21Y 2113/13* (2016.08); *F21Y 2115/10* (2016.08); *G09F 2007/1804* (2013.01); *G09F 2007/1878* (2013.01)

(58) Field of Classification Search
CPC . G09F 7/22; G09F 13/005; G09F 7/18; B61L 5/125; B61L 5/189; F21S 8/08; F21S 8/083; F21S 9/00; F21S 9/02; F21S 9/03; F21V 15/00; F21V 15/01; F21V 23/0464; G08G 1/09
See application file for complete search history.

(56) References Cited

U.S. PATENT DOCUMENTS

| | | | | |
|---|---|---|---|---|
| 5,422,638 A * | 6/1995 | Singer | G08G 1/095 116/63 P |
| 6,035,567 A * | 3/2000 | Cameron | G09F 7/20 116/63 P |
| 2002/0043025 A1* | 4/2002 | Zayas | E01F 13/085 49/33 |

(Continued)

*Primary Examiner* — Benyam Haile

(57) ABSTRACT

The sign pole system disclosed simplifies the FRA requirement by incorporating many features into the sign pole system. The worker operating the pole can quickly raise the pole just by stepping on the lift bar. To lower the pole 'remove the required safety' is done by stepping on the release footstep. The built in LED features will activate only when it is nighttime and when the pole is in the vertical position. The sensitivity to actuate the LED's is adjustable to compensate for night yard overhead lighting. A solar panel keeps the battery charged. When required a pad lock (lock out device) can be inserted into the foot step base to secure the sign pole system in the up position until deemed safe by the worker to remove the sign protection. Manually attaching a night time blue light is no longer required because the LED light is now built into the sign pole and is automatically actuated.

1 Claim, 22 Drawing Sheets

Model BFP-LS
Down Position

(56) References Cited

U.S. PATENT DOCUMENTS

2005/0278998 A1* 12/2005 Sawhney ..... G09F 9/33
40/541
2006/0026877 A1* 2/2006 Dicke ..... G09F 15/0056
40/607.1

* cited by examiner

Model BFP-LS

Model BFP-LS

Sign

Top LED
Pole Mount Fixture

LED
Components

Model BFP-LS

Model BFP-LS

Fig. 06 Charging Controller
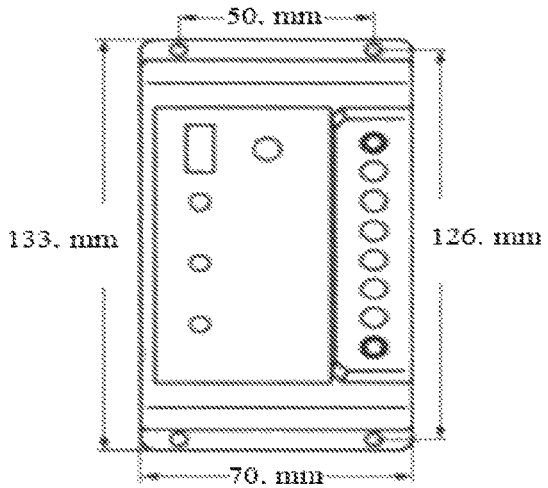
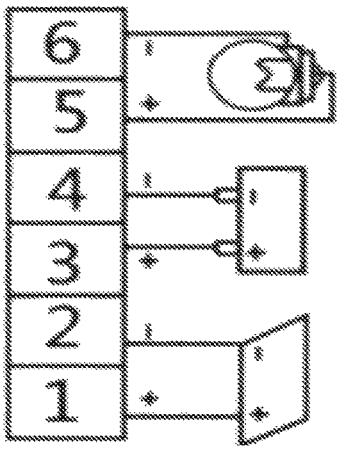

Model BFP-LS

Figure 1:
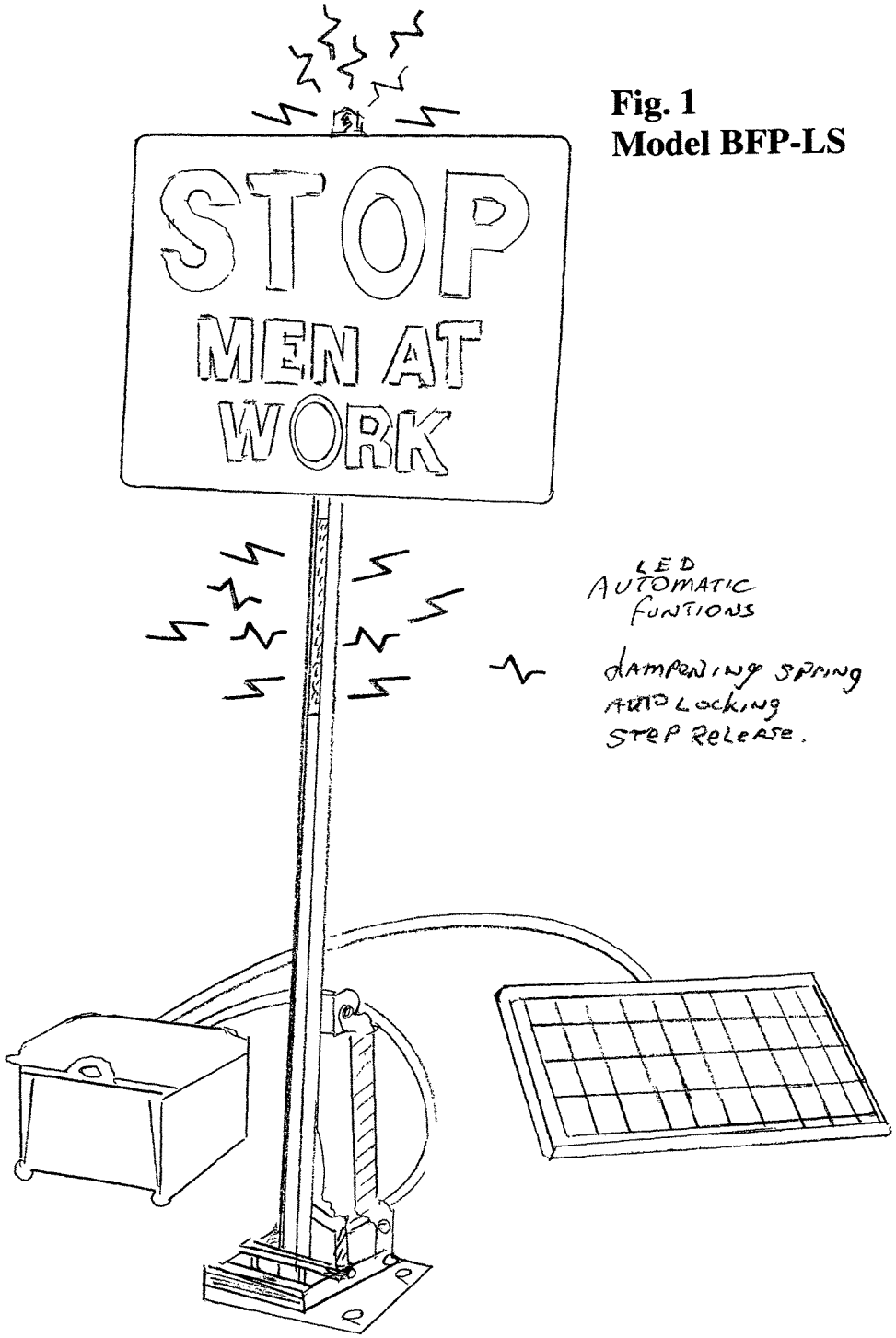
Figure 1A:
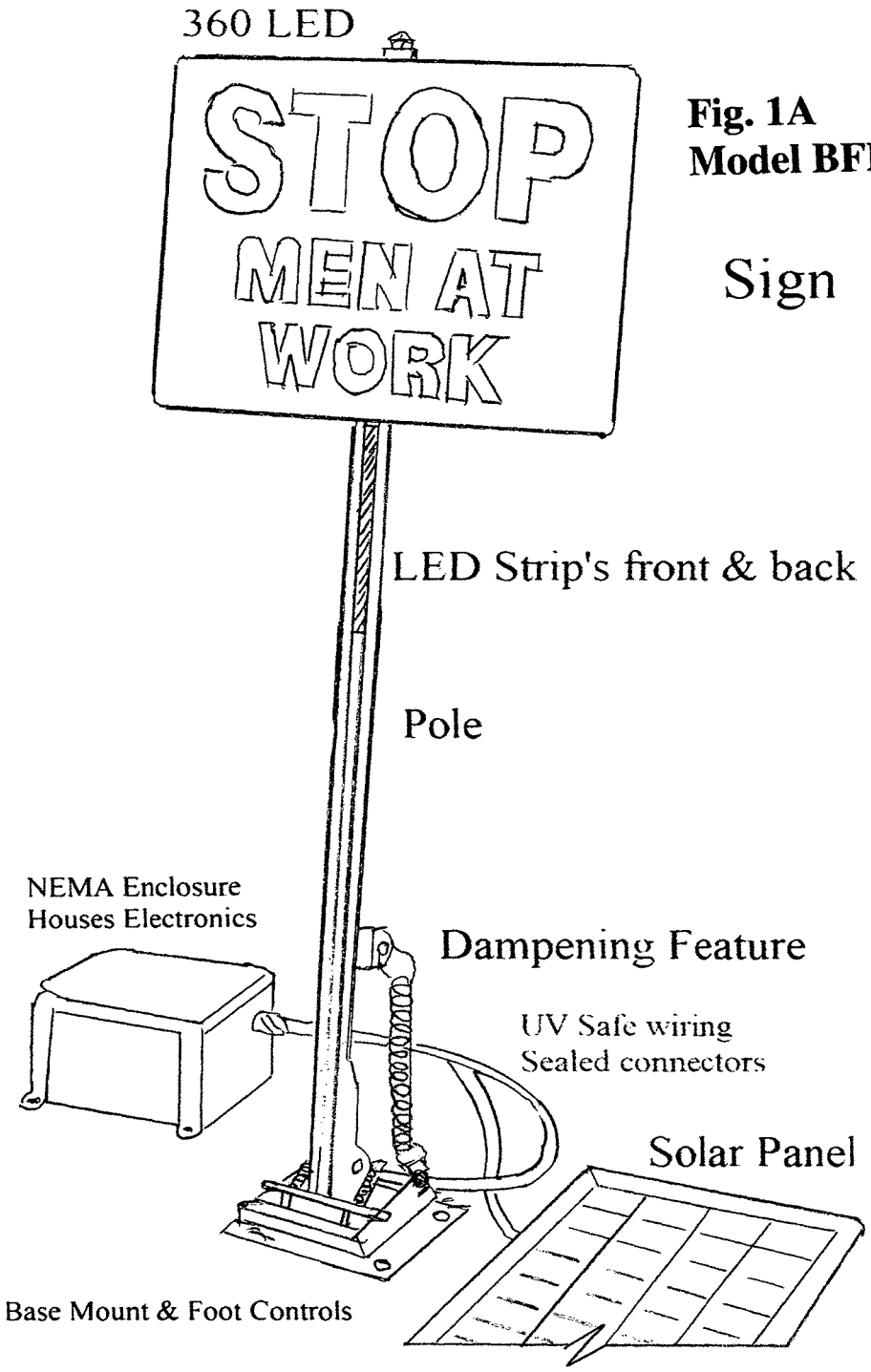
Figure 2:
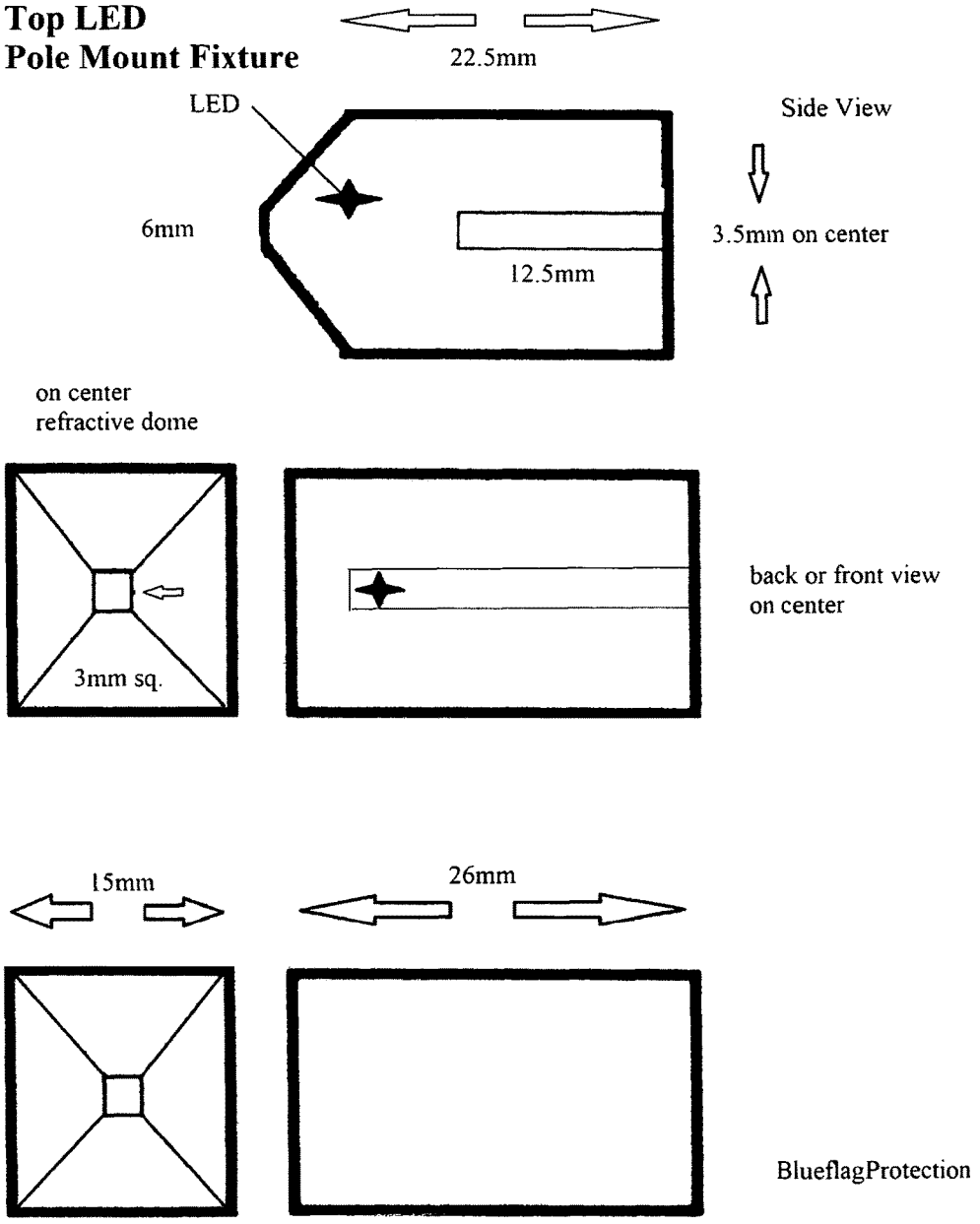
Figure 3:
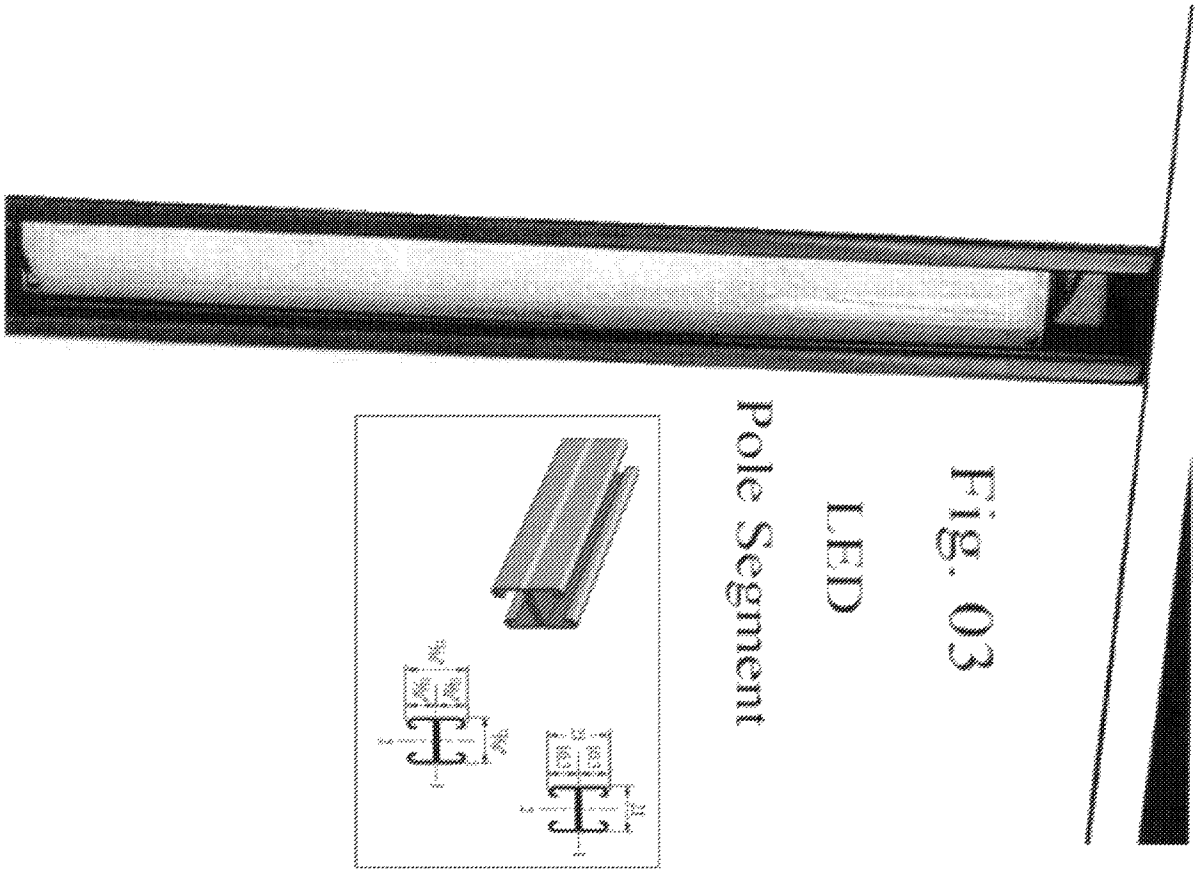
Figure 3A:
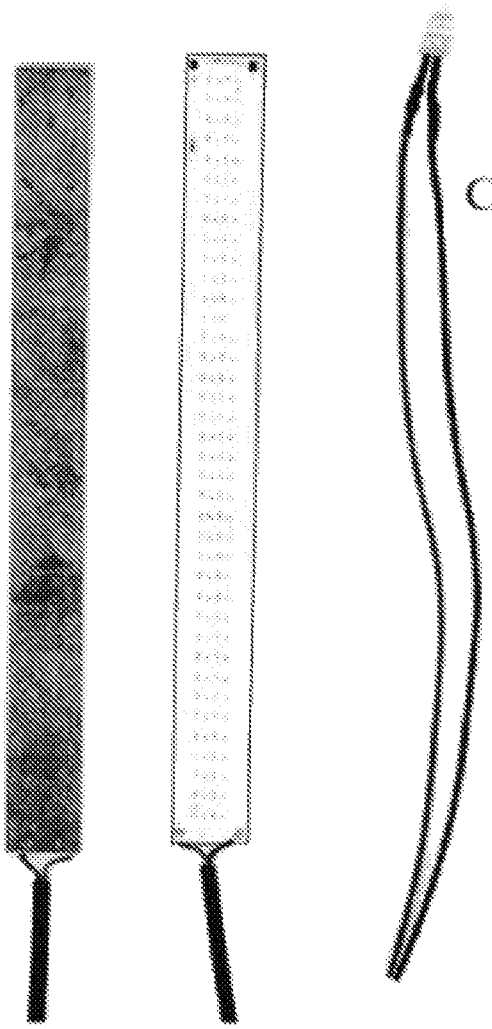
Figure 4:
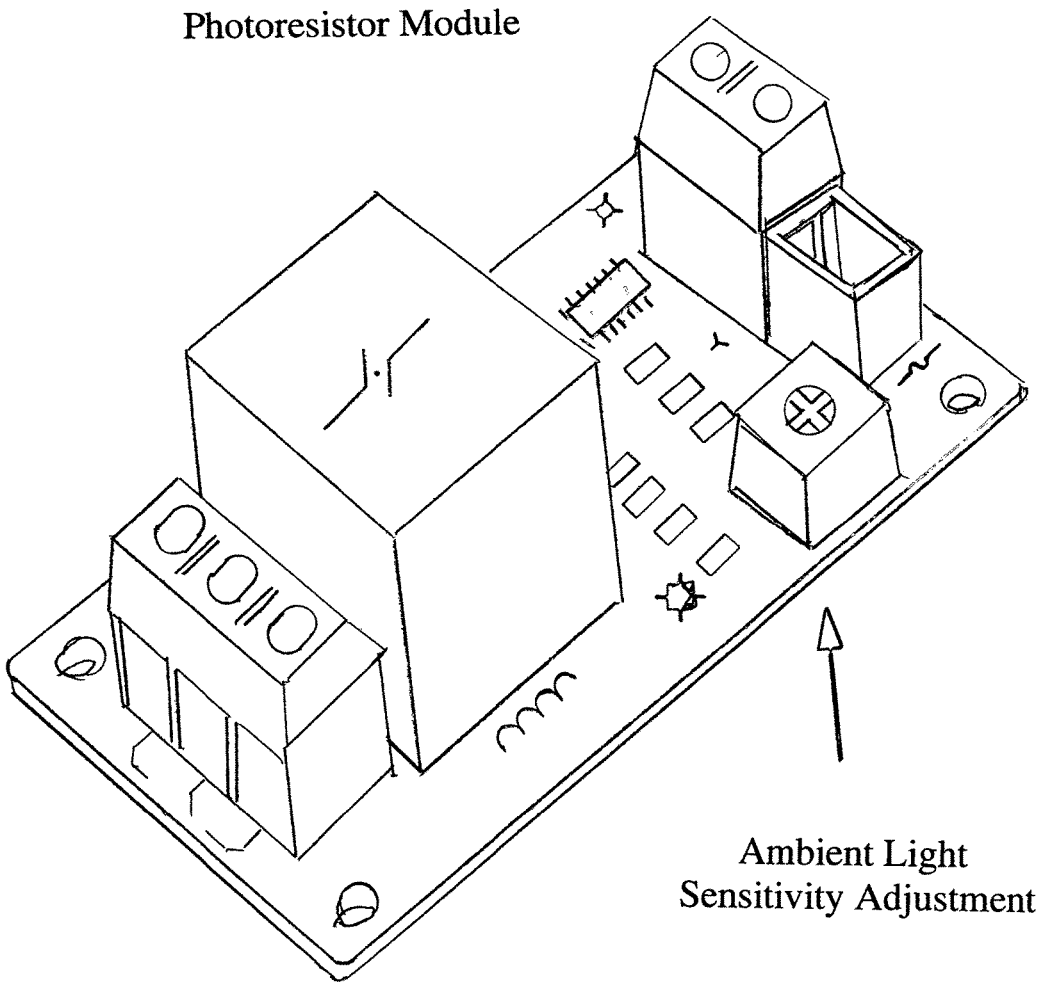
Figure 5:
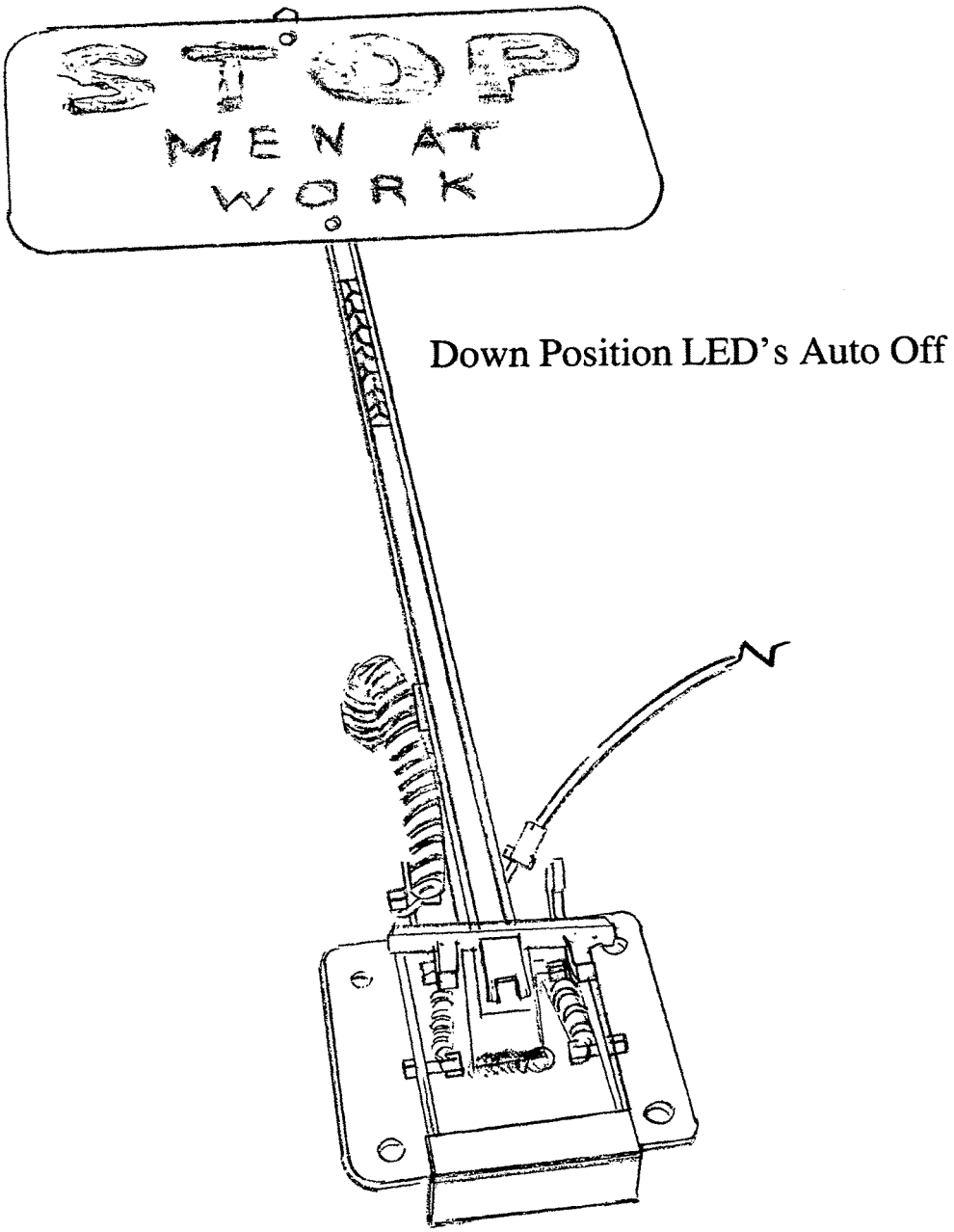
Figure 7:
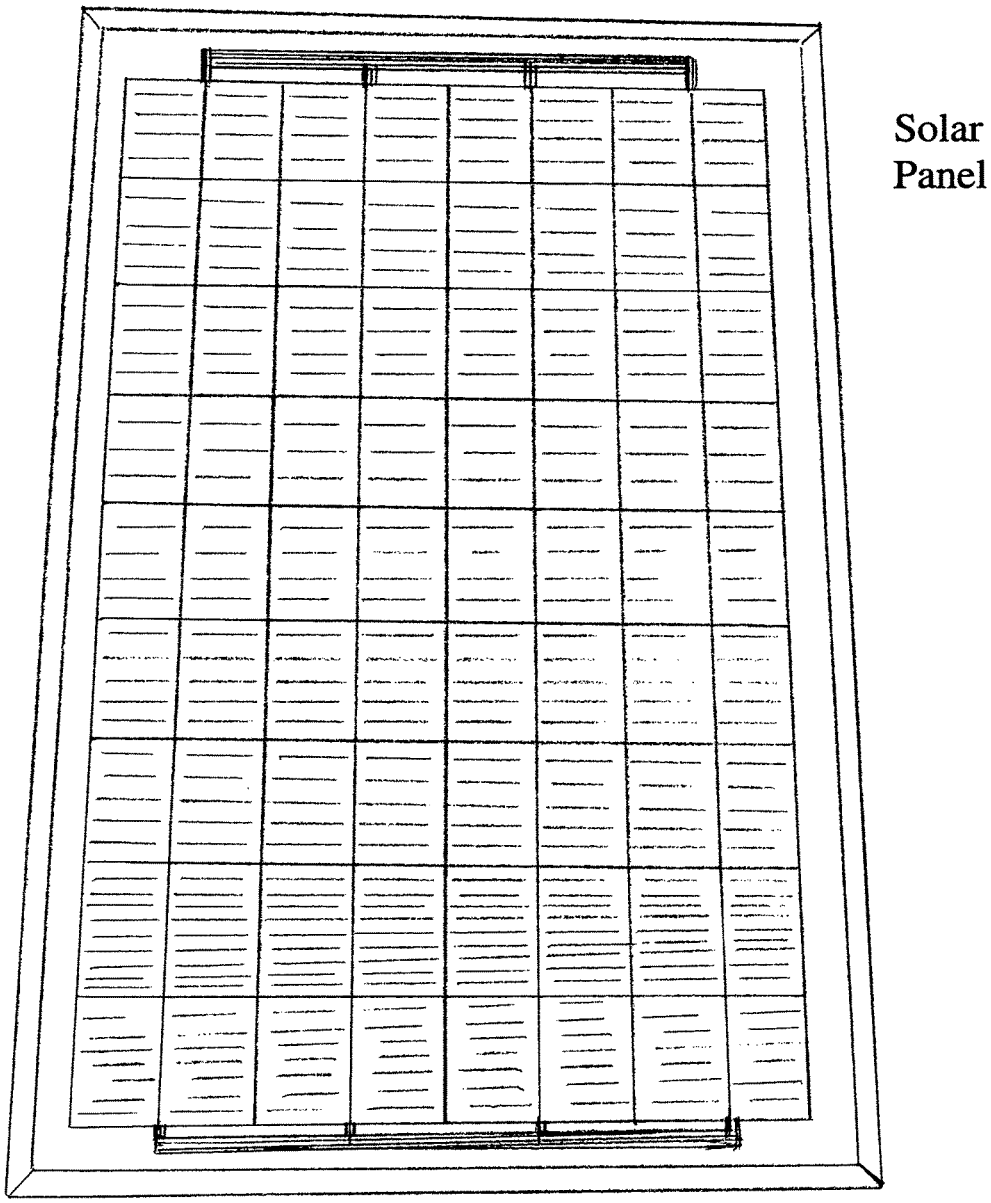
Figure 8:
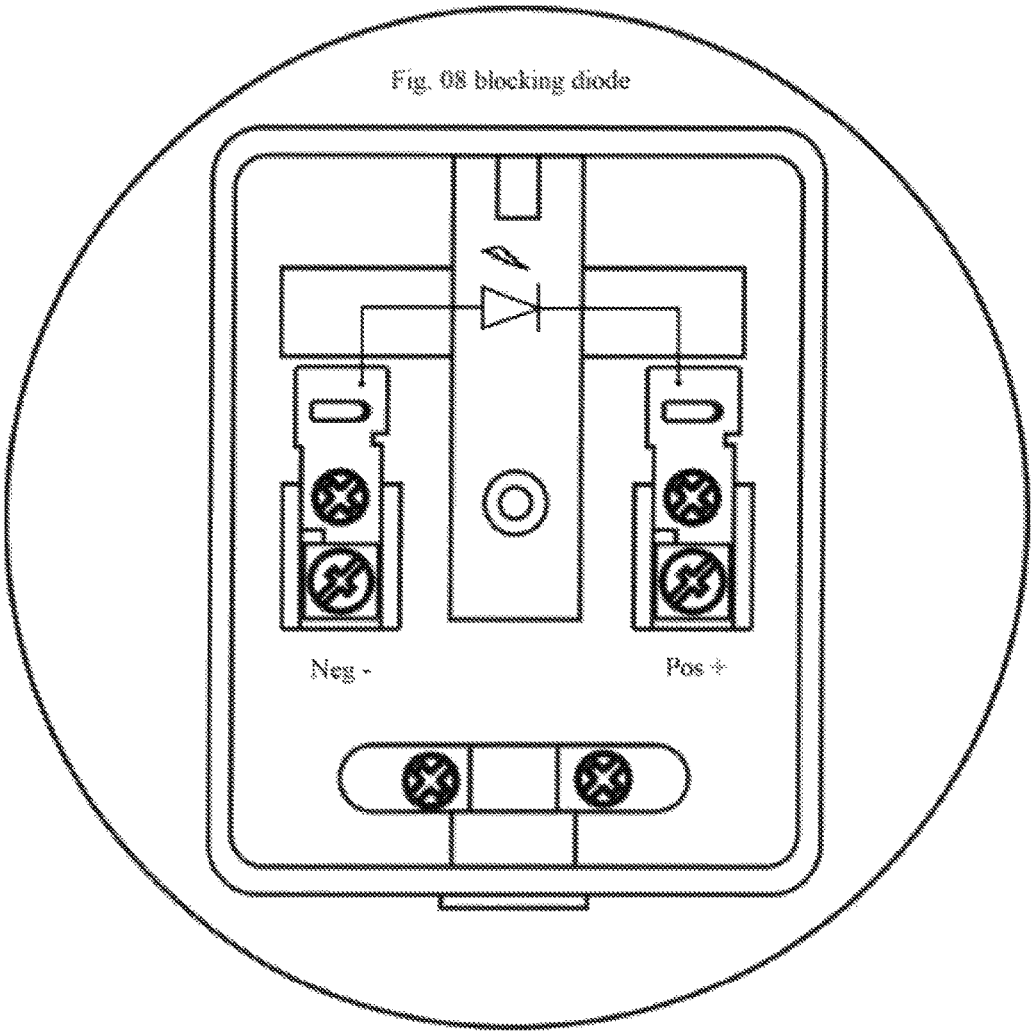
Figure 9:
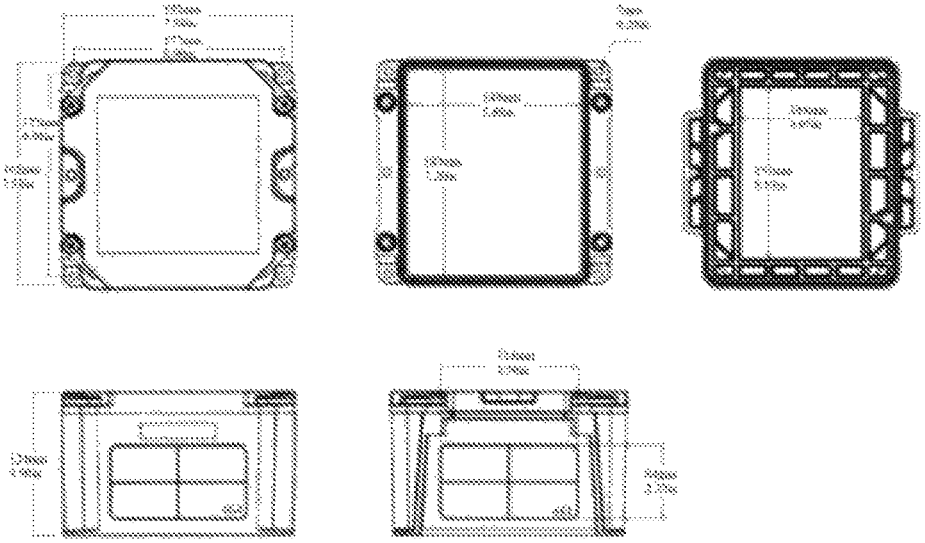

Fig. 08 blocking diode

KRALOY® JBox

*Product Data Sheet*

JBX664 | 278304

MATERIAL
PVC, Glass, IPEX Gasket

STANDARDS
UL 50/50E, CSA 94.1/94.2,
CSA C22.2 No.85, CSA C22.2 No.40

FLAMABILITY RATING
UL 94V-0

OUTDOOR SUITABILITY
UL 746C

BOX VOLUME
172.05 cu.in/2819 ml

NEMA
Type 1, 2, 3R, 4, 4X, 6, 6P, 12, 13

FASTENER TOOL
#2 Phillips screwdriver

Figure 10:
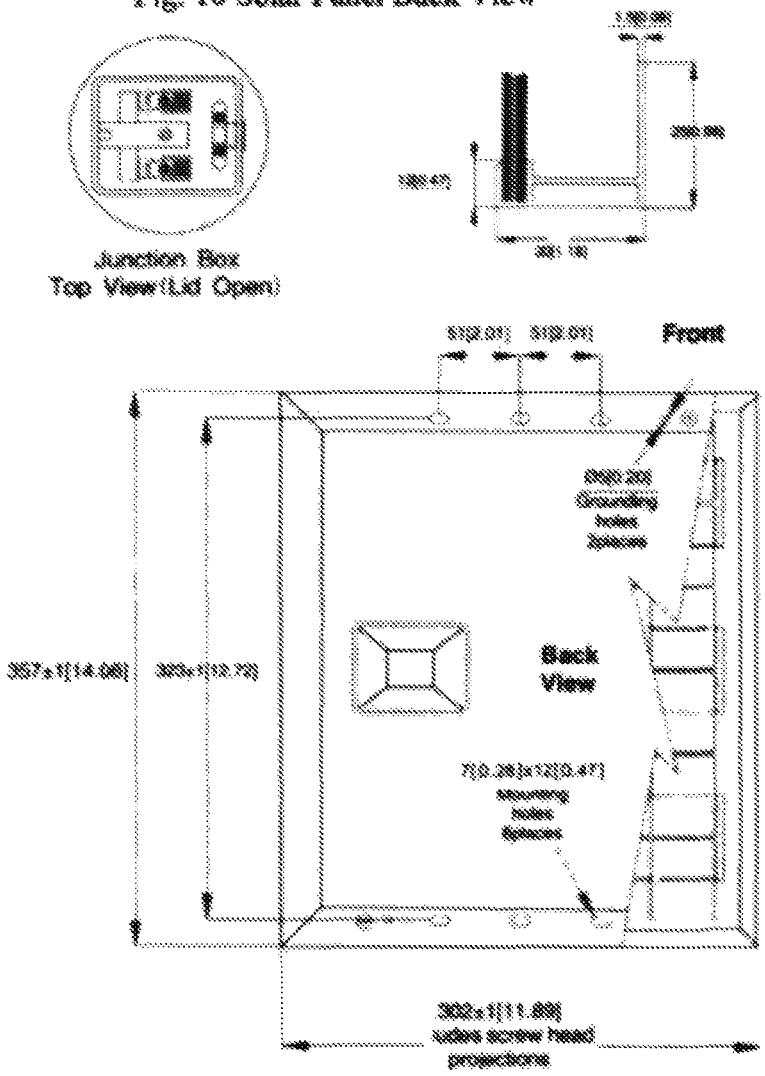
Figure 11:
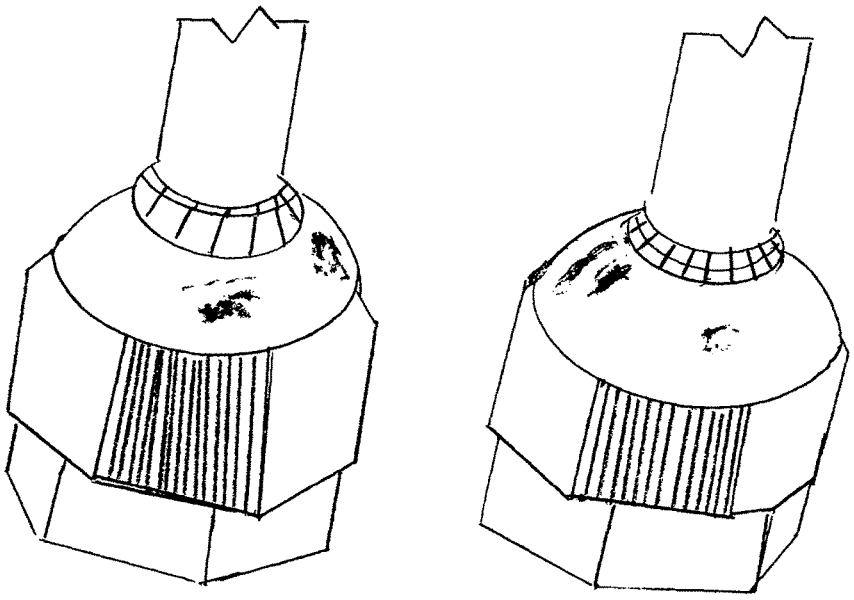
Figure 13:
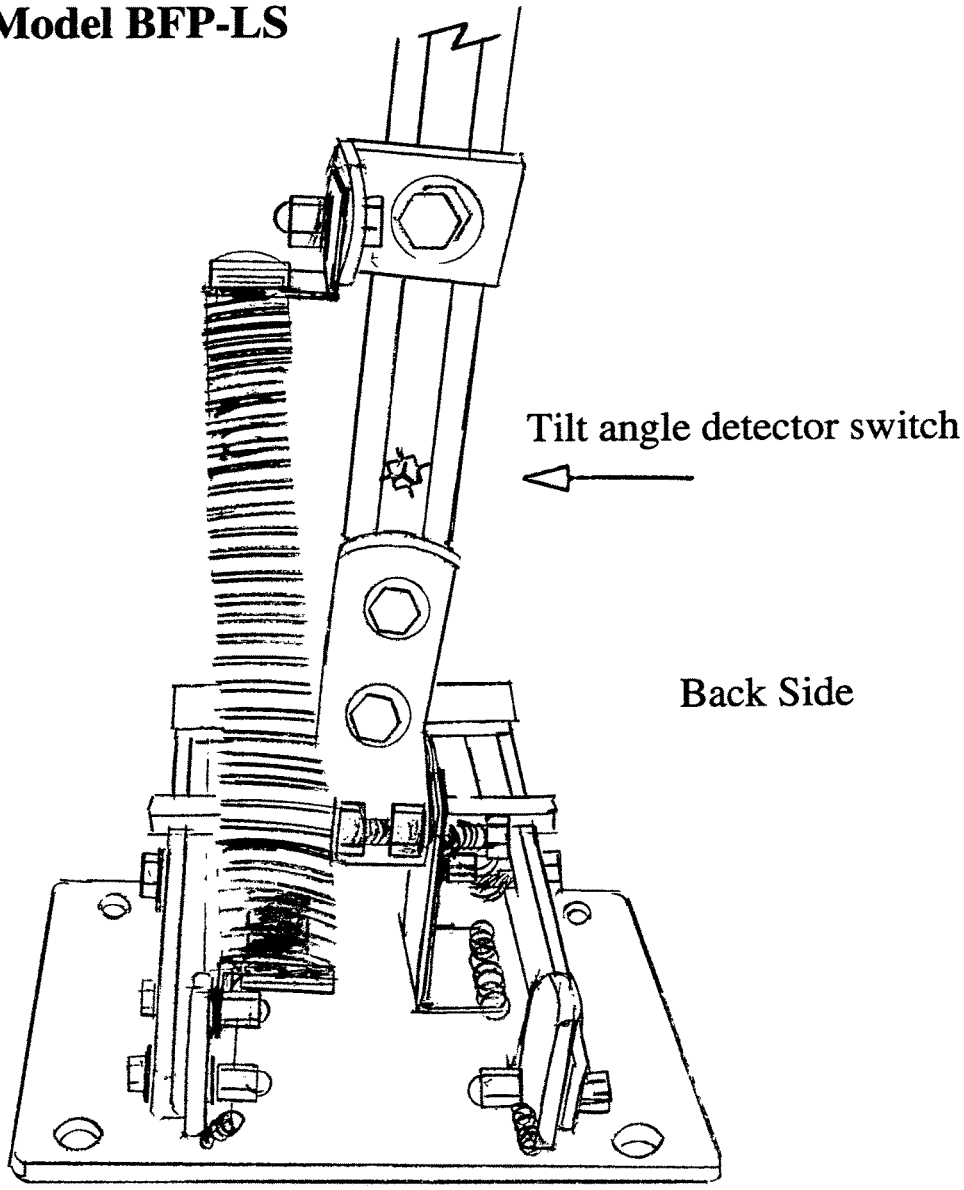
Figure 14:
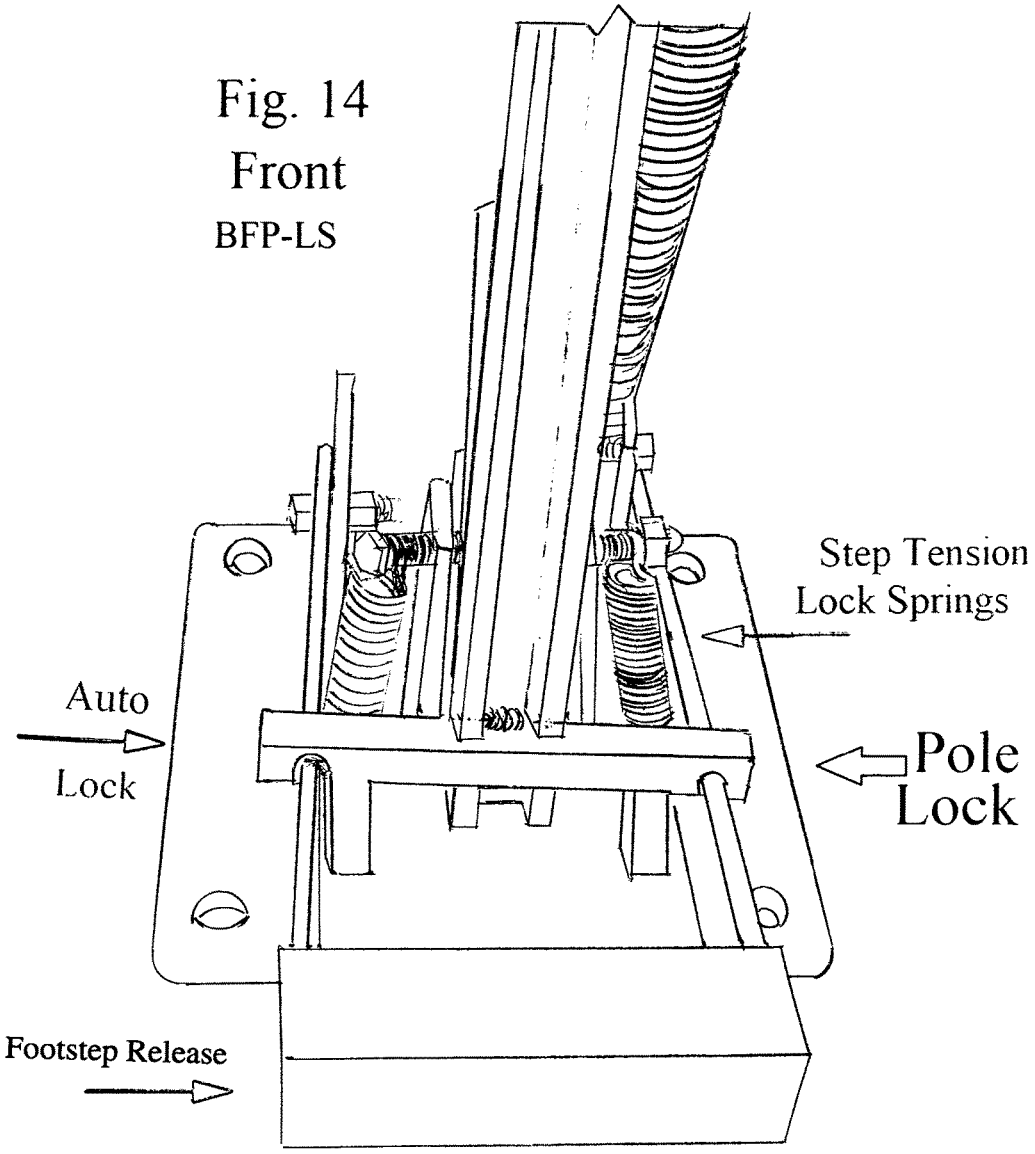
Figure 15:
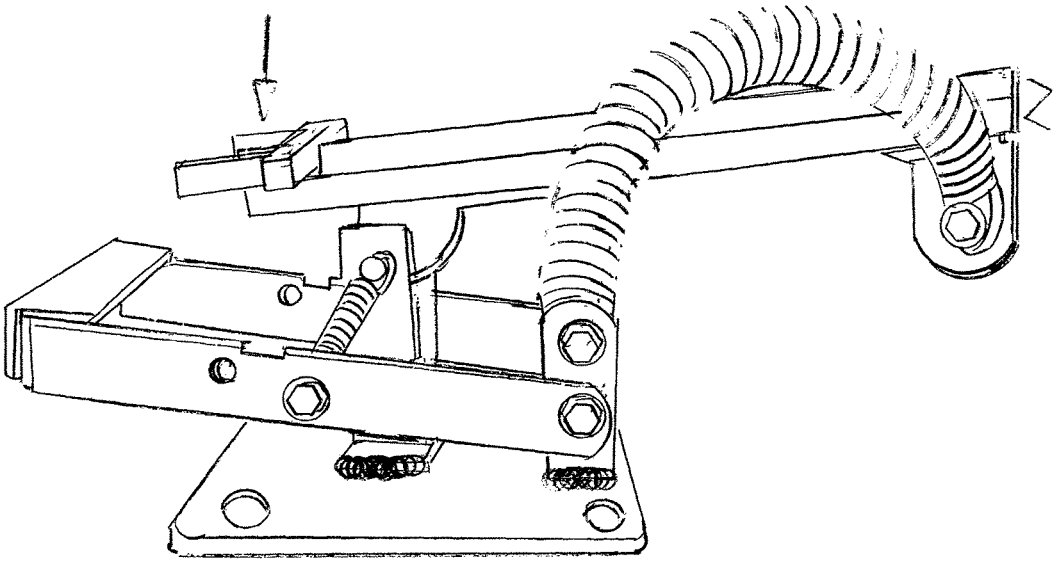
Figure 16:
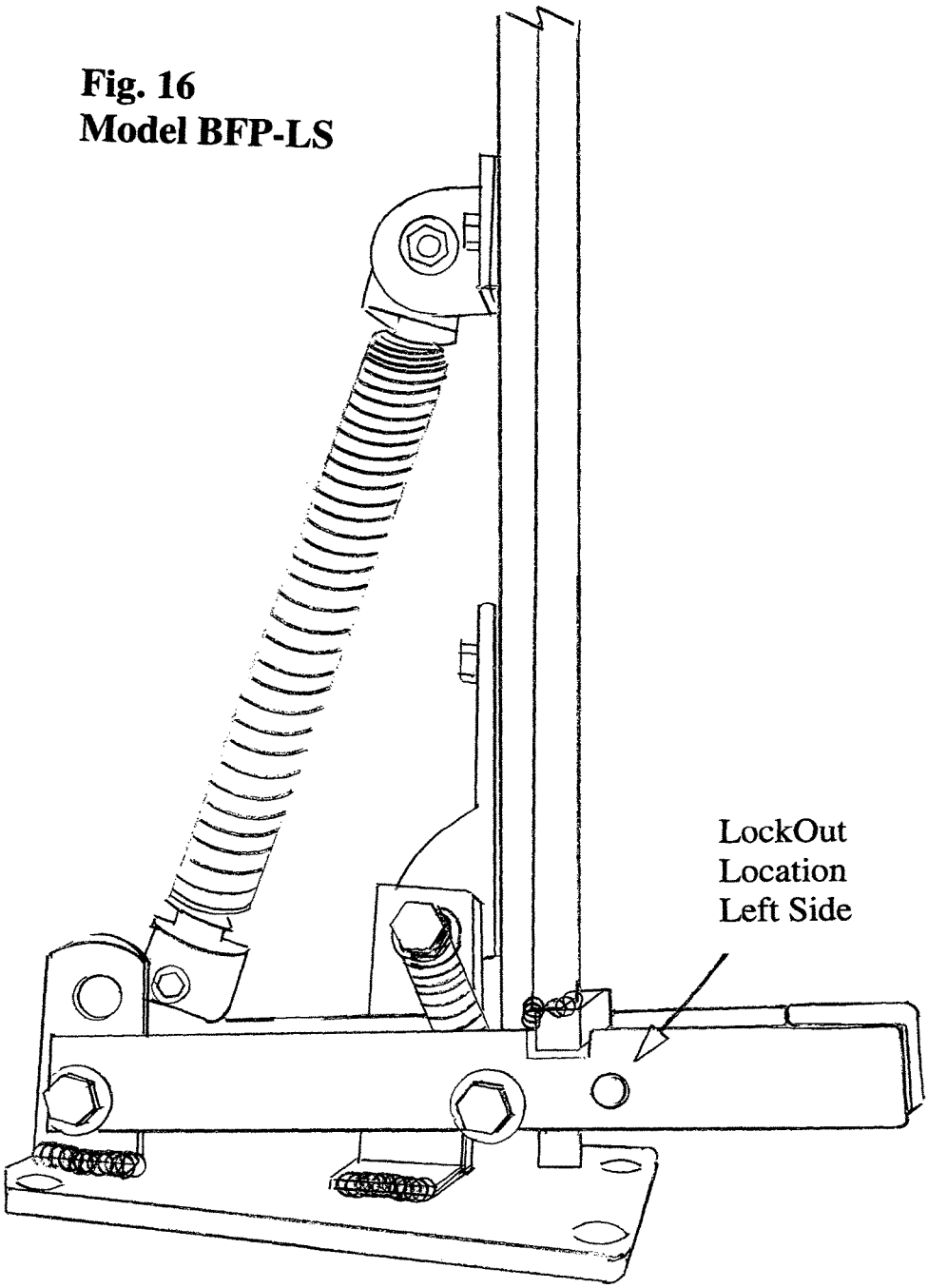
Figure 17:
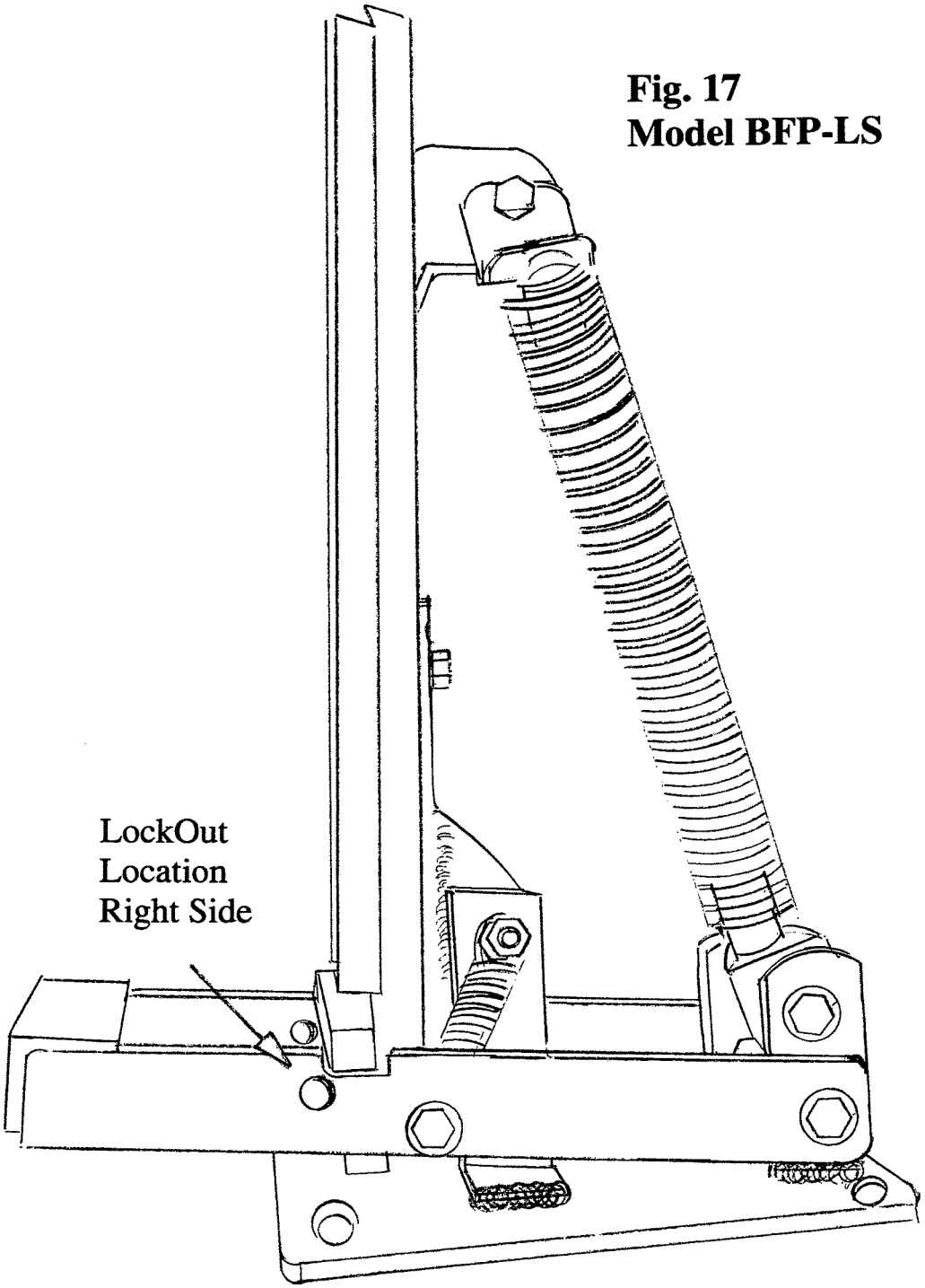
Figure 18:
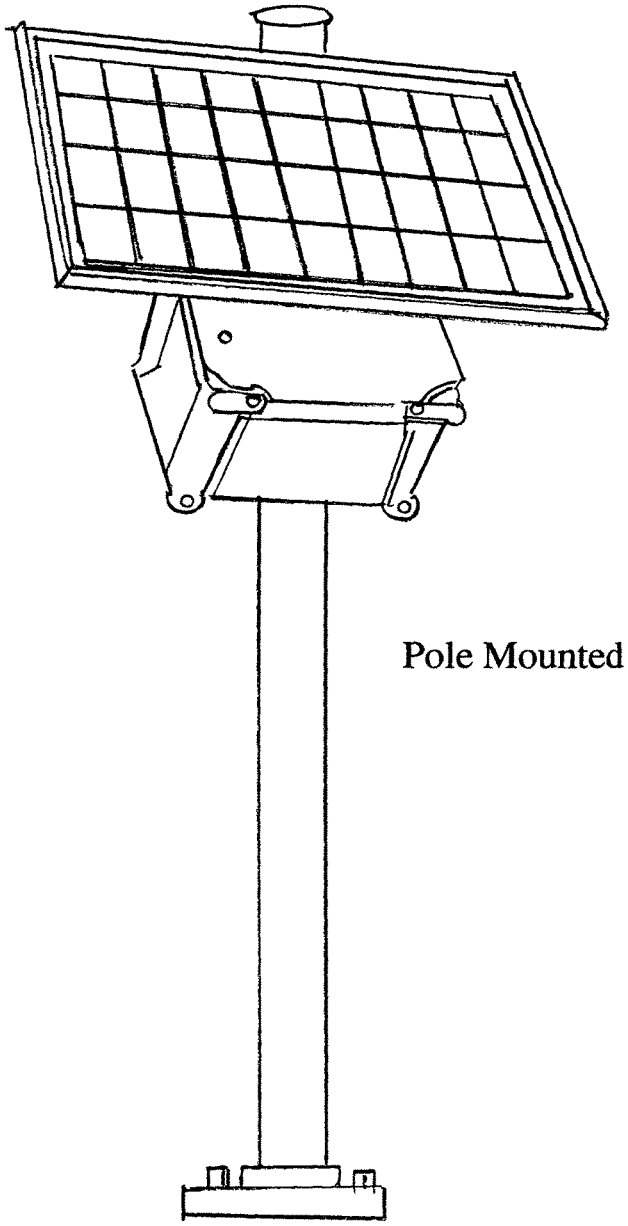

Fig. 10 Solar Panel Back View

Sealed Cable Glands

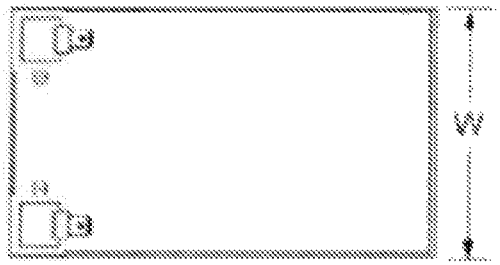
Fig. 12
Power Source
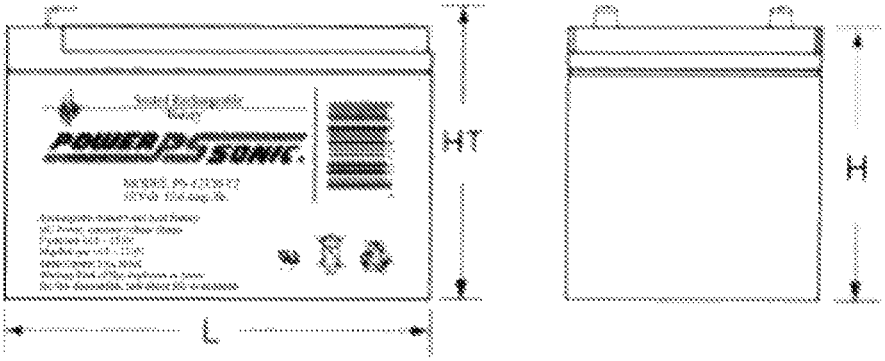
F2: L: 5.94 (151) W: 3.86 (98) H: 3.66 (93) HT: 3.86 (98)
NB: L: 5.94 (151) W: 3.86 (98) H: 3.66 (93) HT: 4.09 (104)
Tolerances are +/- 0.04 in. (+/- 1mm) and +/- 0.08 in. (+/- 2mm)

Model BFP-LS

Front
BFP-LS
Step Tension
Lock Springs
Auto
Lock
Pole
Lock
Footstep Release

Model BFP-LS
Down Position

Step here to auto lift up pole

Model BFP-LS

Model BFP-LS

Model BFP-LS

Fig. 19 Connector 4 Pin
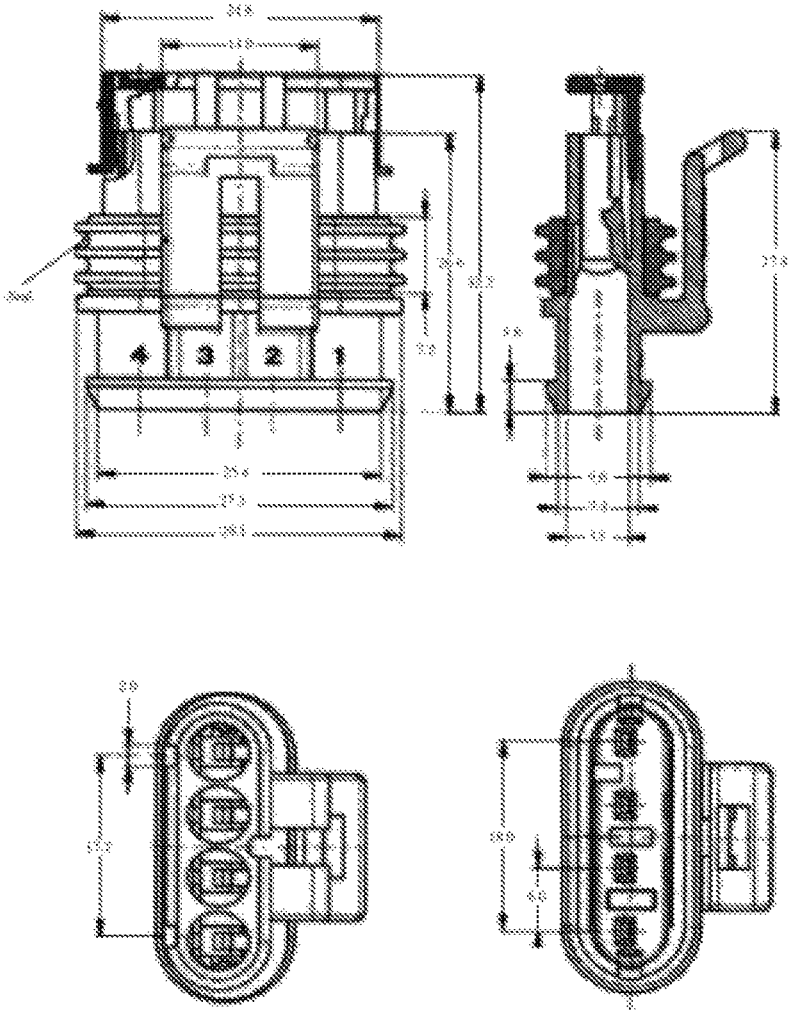

Fig. 20 Connector 2 pin
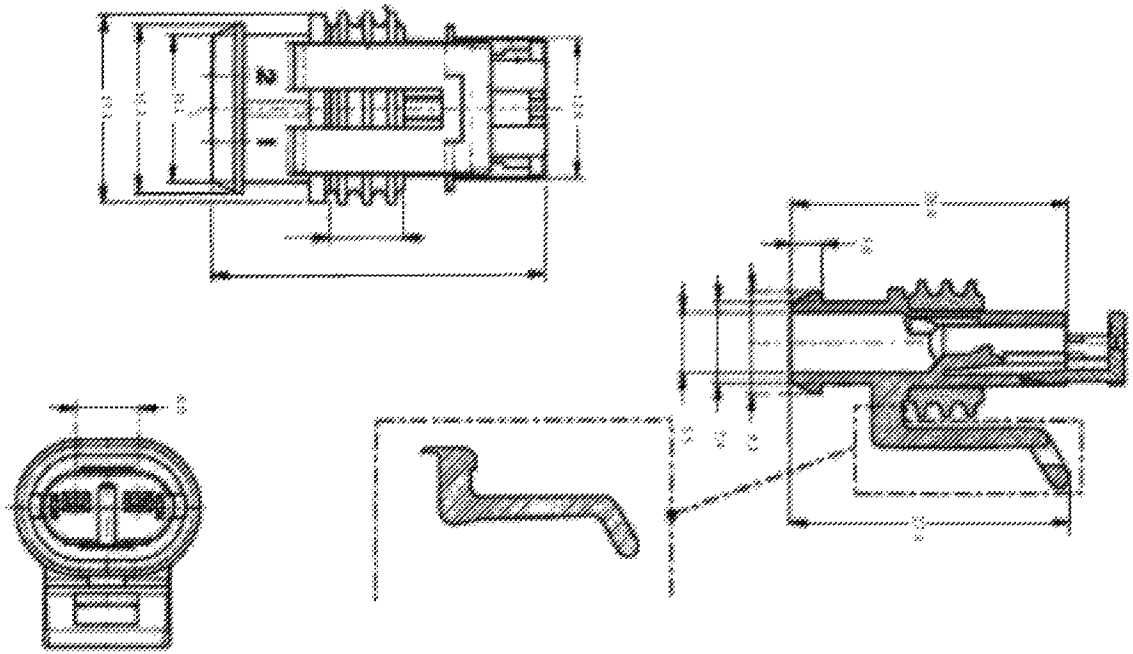

BLUEFLAGPROTECTION AUTOMATIC LED DISPLAY DAMPENED FOOT RELEASED SIGN POLE SYSTEMS

FIG. 1, 1A

Goal was to create a light durable railroad friendly blue flag pole to simplify FRA and local compliance.

Overview

Federal Railroad Administration: FRA 218.23 requires blue signal displayed when work is being done on rail equipment or tracks.

I have invented an auto On Off blue light signal and auto locking pole system that does not require the user to bend over and lift the pole vertically or pull the pole up to secure it. Putting the pole down is simplified with a foot release switch and a dampening feature that assist in being placed in the down position preventing damage to the sign or light fixture as they do not slam to the ground, also LED's are protected within the pole frame. Both items are unique feature.

Claim;

01, FIG. 1, 1A

Automatic LED Display Dampened Foot Released Pole Systems

01A, FIG. 1, 2

One LED on the top of the pole with 360 degree visibility.

01B, FIG. 1, 3, 3A

One LED strip facing forward, One LED strip facing backwards to the rear LED's protected within the frame of the pole.

02, FIG. 1

If it is daylight the Blue LED lighting will remain off. Auto Feature

02A, FIG. 1

If it is daylight the pole sign "Men at Work" or "Safety First" will satisfy FRA blue signal requirements LED's do not need, to be on.

02B, FIG. 1, 4

If it is night no sunlight and the pole is in the upward position the auto feature will turn on the LED's

02C, FIG. 4

If it is night, no sunlight and the pole is in the upward position the auto feature light sensitivity trip on point can be adjusted to compensate for over head track lighting. Preventing false trip states do to overhead night lighting.

02D, FIG. 5

If it is night no sunlight and the pole is in the down position the auto feature will prevent the LED's from illuminating. LED's remain off.

02E, FIG. 4, 06

Pole in the down position day or night power to the photo resistor circuitry is disabled maximizing power to the battery charging controller

03, FIG. 06, 7, 10, 12

If it is daylight the solar panel will feed the charging regulating circuit to charge up the battery. All rights to solar panel held by its manufacture.

03A FIG. 05, 06, 12, 15

Battery Rapid Charge: When the pole is in the down position power to the photoresistor module On Off board is disabled resulting in all the solar panels output to be sent to the charging module for maximum charge.

03B, FIG. 08

Solar Panel safety blocking diode, reverse polarity protection.

04, FIG. 1, 09

Sealed UL, NEMA Enclosure environmentally seals components from elements.

It houses Electronics, photoresistor relay control module, battery charge regulator and Battery. NEMA Enclosure manufactured rights belong to Kraloy JBox

04A, FIG. 09

Enclosure box is lockable or sealable 7 mm. whole diameter can be enlarged

04B, FIGS. 19 & 20

Environmentally sealed connectors, All rights held by manufacture.

04C, FIG. 11

Environmentally sealed Cable Glands, All rights held by manufacture.

04D, FIG. 1

UV ultra violet safe cabling

04E, FIG. 12

Rechargeable maintenance free power source Eliminates replacement disposable batteries. All rights held by manufacture.

05, FIG. 13

Pole features

Raising or lowering pole is assisted with a built in dampening spring.

05A, FIG. 14

To release the pole lock to enable it to be lowered simply step down on the foot switch

05B, FIG. 15

To lift up the pole simply step down on the base of the pole above the foot switch and pull pole back until it auto locks into place.

05C, FIGS. 16 & 17

Built in Lockout Tag Out safety feature, when pole is in the up position to protect, indicate work is being preformed pole can accommodate two pad locks or multi person lockout tags located on the swing arm of the foot release step.

06, FIG. 18

Solar Panel and controller are flat ground mounted for warmer climates but require an optional pole mount for snow or building obstruction. Option requires longer UV cable Pole was designed with railroaders in mind. Years of testing and design modification make this pole user friendly. The auto lock secures the pole in the upright position without having to vertically pull the pole up to secure it. Putting the pole down is simplified with a foot release switch.

Other poles on the market when released slam to the ground resulting in damage to the pole sign and lighting if equipped. Our unique auto dampening slows the downward motion therefore protecting the pole, sign, lighting reducing abuse caused by dropping the pole and assists raising the pole. Made in the USA with exception of the electronics, Assembled in the USA.

Durable solar panel, flat mount for warmer climates and pole mount required for snow or building obstructions.

Maintenance free power source, charging regulation electronics maximizes its life expectancy and are housed in a UL approved lockable environmentally sealed enclosure.

LED Blue light trip Sensitivity is adjustable; this feature is controlled by amount of ambient light and can be adjusted. A very important feature if your pole has to be placed under track lighting that can trigger an off mode placing you in FRA violation during night hours. It's just an adjustment to correct for this problem.

Battery Rapid Charge: When the pole is in the down position power to the auto on off control board is disabled resulting in all the solar panels output to be sent to the charging module for maximum charge.

Locomotives operators in general cannot go over a blue light that is illuminated per FRA. Our pole takes this rule into account. If it is night and the LED light is on. When the pole is placed in the down position the blue LED will be disabled until the pole is placed back in the upright position.

On the other hand if it is day light the Blue LED's will remain off to conserve battery power. The actual "Men At Work" or "Safety First" sign will satisfy requirement during day light hours.

Two built in Lock Out's prevent the pole from being lowered when secured with a pad lock. This number can be increase with the use of an additional multiple person lock out tag.

If you forget to turn on the blue light at night this pole makes it a thing of the past. It will turn on for you.

Again our goal was to create a light durable railroad friendly blue flag pole to simplify your FRA and local compliance.

This system can also be adapted for other purposes and ordered with different color LED's, Clear, Red, Yellow, Blue, Ice Blue.

The invention claimed is:

1. An automatic LED display dampened foot released sign pole system comprising:

a sealed box enclosure for housing electronics and power source;

a pole attached to the box enclosure at a first end, and can be in a horizontal or vertical position;

a foot activated locking mechanism used to raise and lock the pole to a vertical position and lower the pole to a horizontal position;

a pole dampening unit for assisting when the pole is being lowered or raised;

a mounting unit at a second end of the pole for mounting a sign;

indicators in the form of a light emitting diode mounted within a pole channel structure and at the second end of the pole;

a switch for turning the indicators on or off;

a position detector to detect if the pole is in the vertical or horizontal position;

a night detector for detecting if it is a night time;

a solar panel;

a light sensitivity manual adjusting unit for adjusting the indicators light according to the surrounding light;

wherein when the position detector detects that the pole is in a vertical position and the night detector detects that it is night time, the switch turns the indicators on and when the position detector detects the pole is in a horizontal position or it is not a night time, the switch turns the indicators off.

* * * * *